United States Patent [19]

Duffey et al.

[11] 4,033,163

[45] July 5, 1977

[54] APPARATUS FOR SWAGING TUBULAR MATERIAL

[75] Inventors: James R. Duffey, Yellow Springs; Joseph W. Smith, Dayton, both of Ohio

[73] Assignee: Carrier Corporation, Syracuse, N.Y.

[22] Filed: Nov. 26, 1975

[21] Appl. No.: 635,486

[52] U.S. Cl. ..... 72/121; 72/126

[51] Int. Cl.[2] ..... B21D 41/04

[58] Field of Search ..... 72/100, 121, 123, 125, 72/84

[56] References Cited

UNITED STATES PATENTS

| | | | |
|---|---|---|---|
| 1,665,915 | 4/1928 | Ekman | 72/100 X |
| 1,921,810 | 8/1933 | Duchesne | 72/123 |
| 2,649,889 | 8/1953 | Dudley | 72/125 X |
| 3,815,397 | 6/1974 | Hollencamp | 72/121 |
| B377,683 | 1/1975 | Martin | 72/125 X |

*Primary Examiner*—Willie G. Abercrombie

*Attorney, Agent, or Firm*—J. Raymond Curtin; Donald F. Daley

[57] ABSTRACT

The method and tool of this invention functions to reduce the ends of tubular material, such as oil or gas well drill pipe, particularly pipe having a flared end. The tool consists of a mandrel sleeve having an inner tapered surface, a series of conical rollers mounted in a roller cage within the mandrel so the rollers bear against the tapered surface. With the pipe inserted between the rollers and with relative rotational and axial movement between the pipe and the mandrel, the rollers will engage the surface of the pipe applying a swaging force to the pipe which is increased by the decreasing diameter caused by axial movement of the pipe and rollers along the tapered surface.

8 Claims, 2 Drawing Figures

APPARATUS FOR SWAGING TUBULAR MATERIAL

BACKGROUND OF THE INVENTION

This invention relates generally to a method and apparatus for swaging the end of tubular workpieces, such as drill pipe used in oil and gas well drilling and, particularly to a method of swaging the flared end of a tubular member back to its original size and to a swaging tool having a series of rollers rotatable and axially movable within a mandrel sleeve with a tapered internal surface.

The external surfaces of cylindrical metallic workpieces have been processed by forceably engaging the surface of the workpiece with a circular assembly of rollers during relative rotational movement between the workpiece and the assembly of rollers. Where the workpiece is reduced between 0.0005 and 0.015 of an inch, the tool is considered a burnishing tool, where the reduction is size is greater than 0.015 of an inch in the diameter of the workpiece, the tool is considered a swaging tool. Tools of this type are shown in U.S. Pat. No. 3,815,397, issued June 11, 1974, in the name of Eugene A. Hollencamp. In the Hollencamp patent, the outside diameter of a tubular workpiece is reduced by swaging the workpiece with a short conical portion of a series of rollers and finishing the surface with a longer tapered surface of the roller. The final size of the workpiece is determined by adjusting the mandrel cage and locking the mandrel in position. The rollers which reduce the diameter of the workpiece are then held in a position whereby their surfaces will remain axially stationary while the leading surface will engage the workpiece for the swaging operation and the trailing surface will finish or burnish the surface. Because the rollers remain axially stationary, the degree of size reduction is limited. In the present invention, the leading conical surface of the rollers merely guides the workpiece into the roller cage and the long trailing conical surface performs the swaging operation. In addition, the rollers which effect the size reduction in the O.D. of the workpiece are allowed to move axially within a mandrel sleeve. As the rollers move axially inward of the mandrel sleeve, the diameter of the workpiece surface is continually reduced. The desired final O.D. size of the workpiece is determined by setting stops within the tool, limiting the axial movement of the rollers. By this method, a greater size reduction of the workpiece may be accomplished with one setting of the tool

SUMMARY OF THE INVENTION

It is therefore the primary object of this invention to reduce the outside diameter of tubular material.

It is a further object of this invention to swage flared ends of pipes back to their original outside diameter.

It is also an object of this invention to extend the range of swaging tools of the type wherein a series of conical rollers are mounted within a tapered sleeve used to reduce the outside diameter of a tubular workpiece.

It is also an object of this invention to increase the amount of size reduction of a tubular workpiece with a swaging tool of the type having a series of conical rollers mounted within a tapered mandrel sleeve.

It is also an object of this invention to provide a swaging tool of the type having a series of conical rollers mounted within a tapered mandrel sleeve wherein the tapered conical rollers are axially movable within a tapered mandrel to increase the maximum amount of size reduction that can be accomplished on the outside diameter of the workpiece.

These and other objects of this invention are accomplished by means of a series of conical rollers mounted in a roller cage within an elongated tapered mandrel sleeve. The roller cage and rollers are axially movable within the mandrel sleeve to continually reduce the effective diameter between the rollers. A stop member which abuts the workpiece inserted between the rollers is connected to the roller cage to move the roller cage within the tapered mandrel as the workpiece is fed forward into the mandrel sleeve. An adjustable stop is provided to limit movement of the roller cage at the position within the mandrel sleeve where the desired outside diameter of the workpiece will be attained.

DESCRIPTION OF THE PREFERRED EMBODIMENT

Figure 1:
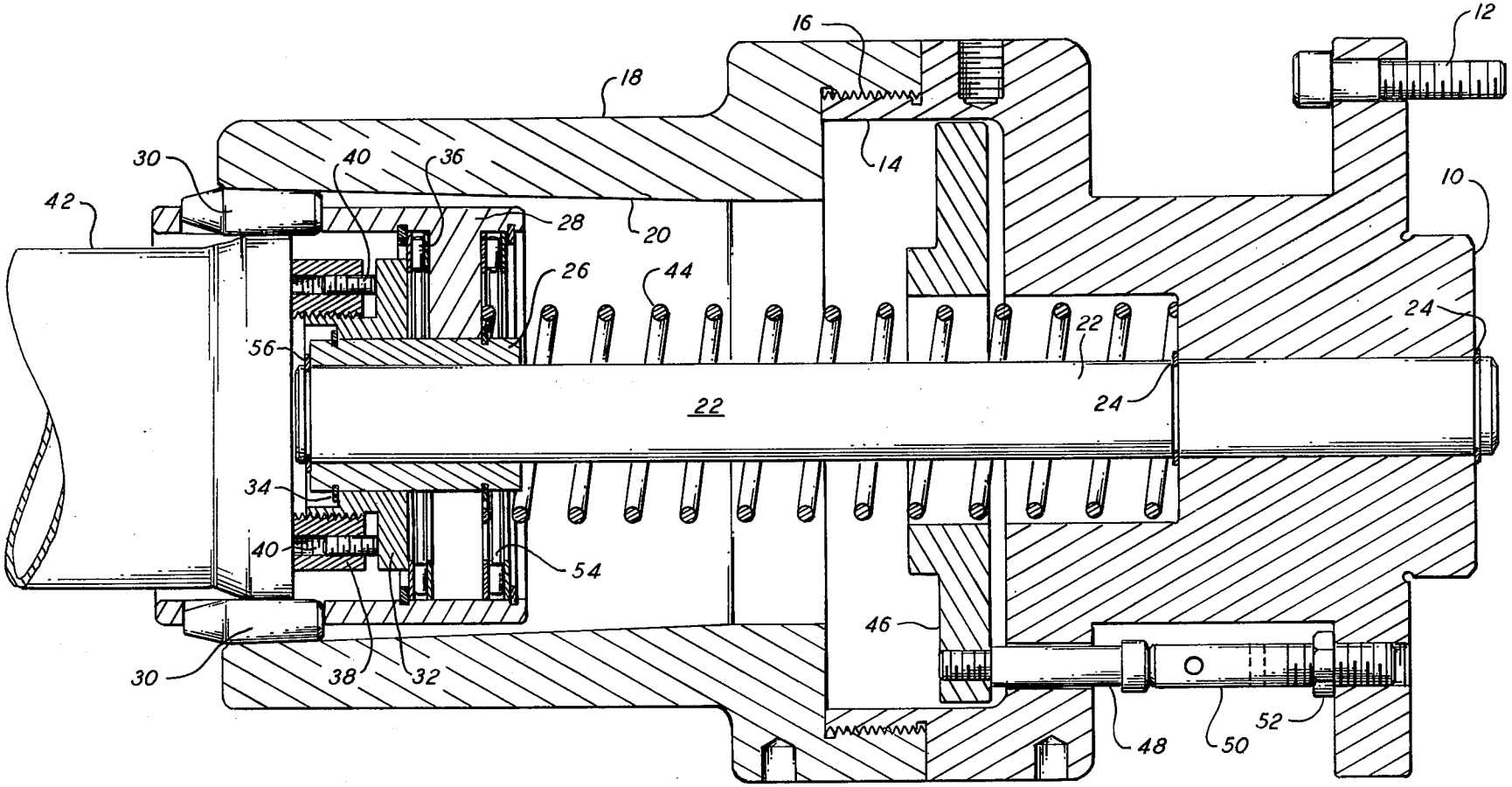
FIG. 1 is a cross-sectional view of a tool embodying the present invention with the swaging rollers in the starting position.

Referring to the drawings, the swaging tool shown therein includes a support or driving member 10 which is adapted to be secured to an auxiliary piece of equipment such as a flange mounted on a lathe, or any other type of rotating equipment which would hold the tool stationary while the workpiece is rotated or a flange mounted on the spindle which would impart a rotating force while the workpiece is held stationary. A series of circumferential bolts 12 are provided for engagement to the flange. The driving member 10 has a bore 14 and a threaded shoulder 16 sized to mate with a threaded shoulder on a mandrel sleeve 18. The mandrel sleeve 18 has an internal bore 20 extending through the sleeve which is tapered from the forward or workpiece end of the sleeve to the rear or driving member end of the sleeve. The internal surface 20 is essentially a conical frustum.

A shaft 22 is centrally mounted in the driving member 10 and extends forward to a position just short of the end of the mandrel sleeve 18. The shaft 20 is retained in the driving member 10 by means of retainer rings 24 mounted in slots on the shaft and engaging each end of the driving member 10. The sleeve bearing 26 is mounted on the shaft 22 and is slidable along the length thereof. A cylindrical roller cage 28 is secured to the bearing 26. It has a series of openings around the periphery sized to accommodate a series of swaging rollers 30. The outside diameter of the roller cage 28 is smaller than the smallest internal diameter of the surface 20 whereby the cage 28 may be moved along the length of the shaft 22 without engaging the wall 20. The rollers 30 are tapered rollers wherein the taper is one-half the taper on the inner conical surface 20 of the mandrel sleeve 18 so that the inner surfaces of the rollers are parallel or horizontal, as seen in the drawings.

The work positioning plug or stop 32 is freely mounted for rotational movement on the bearing 26. The plug 32 is retained from forward movement along the bearing by retaining ring 34 and from rearward movement by thrust bearing 36. The outside diameter of the plug is threaded to receive an annular stop 38 which is cylindrical with internal threads to mate with the external threads on the plug 32. A series of socket head set screws 40 extend through the stop 38 and abut a flanged wall of the plug 32. By adjusting the set screws 40 and threading the stop 38 onto the plug 32, the position of the workpiece 42 relative to the rollers 30 may be preset. The workpiece 42 is moved in between the rollers 30 until it abuts stop 38 thus determining the axial length of the workpiece 40 which is to be worked by the rollers 30.

A compression spring 44 surrounds the shaft 22 and bears against the rear portion of the roller cage 28 and the driving member 10. Stop plate 46 is positioned within the bore 14 of the driving member 10 and may be adjusted by means of a series of socket head shoulder screws 48 which extend through driving member 10 and are threadedly engaged with the stop plate 46. The end of the socket screws 48 abut in adjustment stud 50 which is threaded into a flange portion of the driving member 10 in the same relative position as each of the socket head shoulder screws 48. Adjustment studs 50 may be threadedly positioned within the flange of the driving member 10 and locked into place by jam nut 52 thus determining the rearwardmost position of the stop plate 46.

Figure 2:
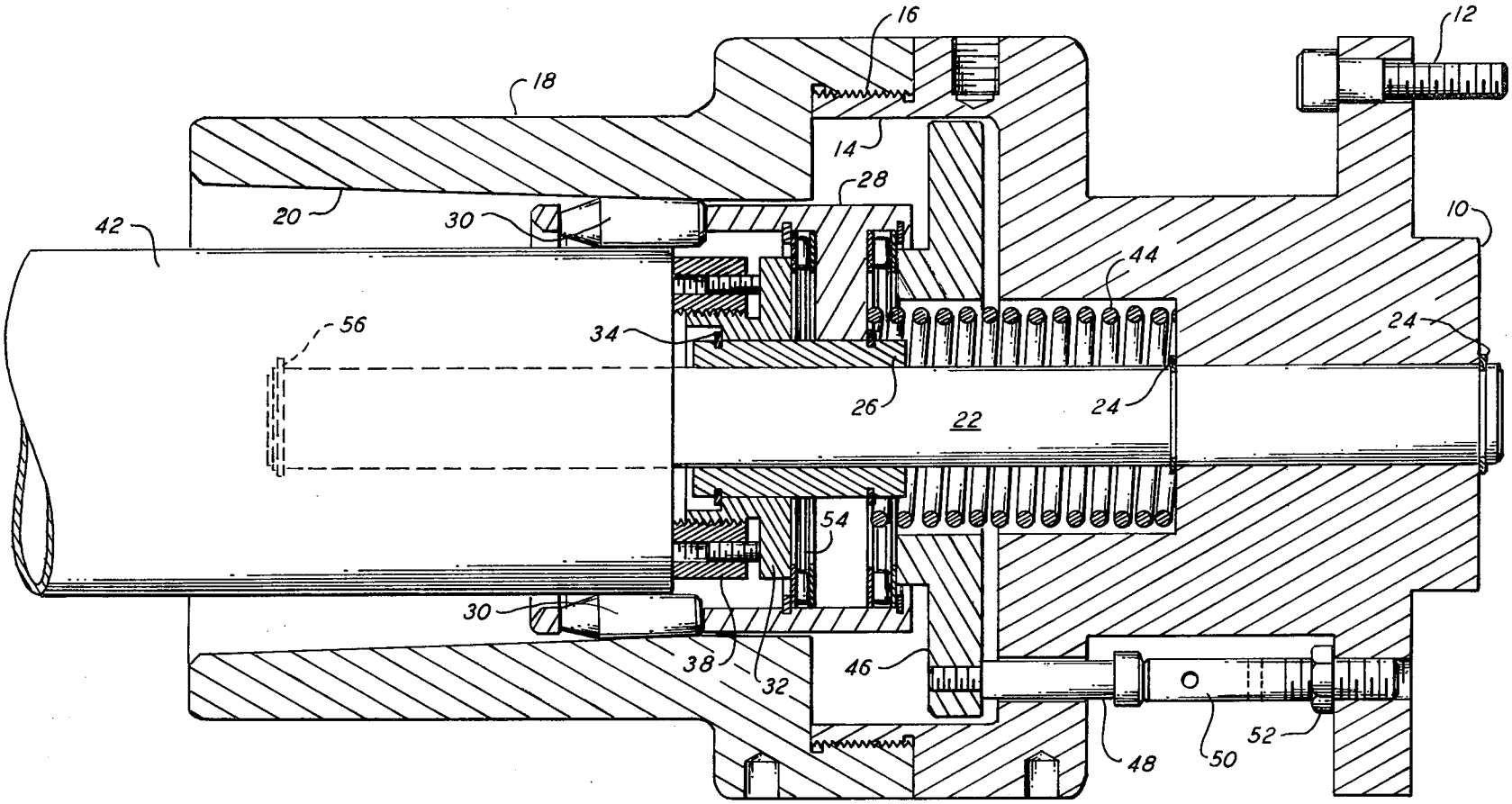
FIG. 2 is a cross-sectional view of a tool embodying the present invention with the swaging rollers in the final position.

Referring to FIG. 2, it can be seen that the rearward movement of the bearing 26 and the roller cage 28 against the action of the compression spring 44 is limited by the stop plate 46 bearing against a thrust bearing 54.

In the operation, the swaging tool is mounted to a rotating tool, such as a lathe, by means of the bolts 12 and the driving member 10. The tool may be rotated with the workpiece held stationary or the tool may be held stationary with the workpiece rotated. The tubular workpiece 42 with a flared end, as shown in FIG. 1, is held in position in alignment with the forward end of the tube. The final size of the flared end of the tube is set by adjusting the stop plate 46 so that when it is engaged by the thrust bearings 54, the distance between the inside edges of the rollers 30 will be the desired dimension on the tube. Before the workpiece 42 is inserted into the tool, the compression spring 44 has urged the roller cage 28 and bearing 26 forward along the length of the shaft 22. Bearing 26 is in contact with a retaining ring 56 on the end of the shaft. The rollers 30 are restrained from falling through the openings in the cage 28. The cage 28, with the openings therein, also prevents axial movement of the rollers 30 relative to the cage. The axial length of the workpiece 42, which is to be worked by the rollers 30, is predetermined and set by means of adjustment of the stop 38 relative to the work positioning plug 32.

With the stop 38 and the stop plate 46 adjusted for the desired working diameter and axial length, the workpiece 42 can be inserted between the rollers 30 until it abuts the stop 38. Continued forward movement of the workpiece 42 will slide the bearing 26 axially along the shaft 22 against the action of the compression spring 44 until the rollers 30 are in contact with the surface 20 of the mandrel sleeve 18 and in contact with the workpiece 42. Rotational movement of the driving member 10 or the workpiece will produce relative rotational movement between the rollers and the mandrel sleeve 18 causing the rollers 30 to rotate around the periphery of the workpiece 42. As the workpiece 42 is fed forward, bearing 26 carrying cage 28 is also fed axially inward of the mandrel sleeve 18 and the tapered surface 20 causes the distance between the rollers 30 to decrease thus decreasing the O.D. of the workpiece 42. When the thrust bearing 54 engages the stop plate 46, forward movement of the workpiece 42 is discontinued and the workpiece 42 may be withdrawn from the tool with the desired outside diameter. The rollers 30 may be skewed at an angle to the axis of the tool, if desired, to provide a self-feeding movement to advance the tool relative to the workpiece.

While we have described the preferred embodiment of our invention, it is to be understood that the invention is not limited thereto, but may be otherwise embodied within the scope of the following claims.

What we claim is:

1. A swaging tool for working the outside diameter of the end portion of a tubular workpiece including;

a mandrel sleeve having an internal tapered surface, and a series of rollers mounted within the mandrel for contact with the outside surface of a workpiece inserted into the mandrel, said rollers being axially movable relative to the tapered surface by the workpiece during operation of the tool, whereby relative rotational movement between the mandrel and the workpiece will produce rolling contact between the rollers and the workpiece, and relative axial movement between the mandrel and the workpiece will produce axial movement of the rollers relative to the mandrel, thereby forcing the rollers against the surface of the workpiece and decreasing the outside diameter of the workpiece.

2. The swaging tool as set forth in claim 1 wherein the series of rollers are mounted in a series of peripheral openings in a roller cage axially movable along the length of the mandrel sleeve, said roller cage having means associated therewith to limit inward radial movement of the rollers when the rollers do not engage a workpiece and to be contacted by a workpiece to limit the axial length of the contact between the workpiece and the rollers and to advance the roller cage and rollers axially relative to the tapered surface when there is relative axial movement between the workpiece and the mandrel.

3. The swaging tool as set forth in claim 2 wherein biasing means urge the roller cage and rollers axially against the movement of a workpiece and the axial movement of the roller cage against the biasing means is limited by an adjustable stop.

4. The swaging tool as set forth in claim 1 wherein the rollers are skewed relative to the axis of the mandrel to provide self-feeding of the workpiece when there is relative rotational movement between the mandrel and the workpiece.

5. A swaging tool for working the outside diameter of the end portion of a tubular workpiece to a smaller diameter comprising a mandrel sleeve having an internal tapered surface, means to rotate the mandrel relative to a workpiece, a shaft extending through the center of the mandrel, a roller cage mounted on the shaft within the mandrel and slidable along the shaft, a series of conical rollers spaced around the periphery of the roller cage in contact with the tapered surface of the mandrel sleeve, the conical surface on the rollers being tapered the same as the taper on the bore surface whereby the surfaces of the rollers opposite the surfaces in contact with the bore surface are parallel, means slidably mounted on the shaft within the roller cage to position the workpiece relative to the rollers and to advance the roller cage relative to the mandrel sleeve during relative axial movement of the tool and workpiece, and adjustable stop means to limit the sliding movement of the roller cage along the shaft to thereby set the outside diameter of the workpiece after rotational contact with the rollers.

6. The swaging tool as set forth in claim 5 wherein biasing means urge the tubular roller cage outward and into contact with a workpiece inserted into the mandrel sleeve.

7. The swaging tool as set forth in claim 5 wherein the roller cage and the means to position the workpiece are both mounted on a bearing slidably mounted on the shaft.

8. The swaging tool as set forth in claim 7 wherein the means to position the workpiece relative to the rollers includes a work positioning plug secured to the bearing and an annular-shaped stop member mounted on the plug and axially adjustable relative to the plug and to the roller cage, the stop member being positioned, relative to the plug, to contact a workpiece inserted into the roller cage.

* * * * *